US010641460B1

(12) United States Patent
Chen

(10) Patent No.: US 10,641,460 B1
(45) Date of Patent: May 5, 2020

(54) LAMPSHADE AND LAMP

(71) Applicant: Zhifang Chen, Guangzhou, Guangdong (CN)

(72) Inventor: Zhifang Chen, Guangdong (CN)

( * ) Notice: Subject to any disclaimer, the term of this patent is extended or adjusted under 35 U.S.C. 154(b) by 0 days.

(21) Appl. No.: 16/657,005

(22) Filed: Oct. 18, 2019

Related U.S. Application Data

(63) Continuation of application No. PCT/CN2019/096561, filed on Jul. 18, 2019.

(30) Foreign Application Priority Data

May 29, 2019 (CN) ..... 2019 1 0457962

(51) Int. Cl.
*F21V 21/00* (2006.01)
*F21V 1/14* (2006.01)
*F21V 1/06* (2006.01)

(52) U.S. Cl.
CPC ..... *F21V 1/143* (2013.01); *F21V 1/06* (2013.01)

(58) Field of Classification Search
CPC ..... F21V 1/143; F21V 1/06
USPC ..... 362/357, 351, 353, 355, 356, 434, 435
See application file for complete search history.

(56) References Cited

U.S. PATENT DOCUMENTS 3,557,362 A * 1/1971 White ..... F21V 1/00 362/358
4,212,052 A * 7/1980 Chambard ..... F21V 1/06 362/352
4,383,291 A * 5/1983 Gall ..... F21V 1/06 362/352
4,727,461 A * 2/1988 Naumoff ..... F21V 1/06 362/352
4,841,424 A * 6/1989 Weber ..... F21V 1/06 362/352
6,517,220 B2 * 2/2003 Wu ..... F21V 1/06 362/352
7,267,458 B2 * 9/2007 Bin ..... F21V 1/06 362/352
2002/0089855 A1 * 7/2002 Mei Ju ..... F21V 1/06 362/351
2012/0206925 A1 * 8/2012 Shenk ..... F21V 1/06 362/352

(Continued)

FOREIGN PATENT DOCUMENTS

WO WO-8901113 A1 * 2/1989 ..... F21V 1/06

*Primary Examiner* — Laura K Tso
(74) *Attorney, Agent, or Firm* — Lerner, David, Littenberg, Krumholz & Mentlik, LLP

(57) ABSTRACT

The invention provides a lampshade, which solves the problem that the prior art lampshade adopts an overall package and has high transportation cost and is easy to be damaged. A lampshade includes at least two ring covers arranged one above the other and a lampshade cloth surrounding an outer circumferential wall of each of the ring covers to form a closed cover body, the lampshade cloth comprising a mounting surface and a decorative surface, which are oppositely disposed. A rib and a groove for connecting and fixing the lampshade cloth and the ring cover are disposed between the outer circumferential wall of the ring cover and the mounting surface of the lampshade respectively; the rib and the groove are elastically snap-fitted; and the lampshade cloth is elongated and both ends of it are detachably connected with each other.

18 Claims, 4 Drawing Sheets

(56) References Cited

U.S. PATENT DOCUMENTS

2012/0275169 A1* 11/2012 Pei-Lin ..... F21V 1/06
362/352
2013/0010477 A1* 1/2013 Wu ..... F21V 1/06
362/351

* cited by examiner

LAMPSHADE AND LAMP

CROSS-REFERENCE TO RELATED APPLICATIONS

The present application is a continuation of International Application No. PCT/CN2019/096561, filed Jul. 18, 2019, which claims priority from Chinese Patent Application No. 201910457962.2, filed on May 29, 2019, the disclosures of which are hereby incorporated by reference.

FIELD OF THE INVENTION

The present invention relates to the field of lamps, in particular to a lampshade and a lamp.

BACKGROUND OF THE INVENTION

A common lampshade is generally composed of two ring covers arranged one above the other and a lampshade cloth surrounding a circumferential wall of the ring covers and connecting the two ring covers together. The lampshade cloth acts as a supporting element to support the ring covers. Prior art lampshades usually stick the lampshade cloth to the circumferential wall surface of the ring covers. After forming a closed shape, an upper and lower ends of the lampshade cloth are folded inwardly to wrap the ring covers, thereby realizing the production assembly of the lampshade. However, assembly in this way requires high manual assembly, and the consistency in assembly of the lampshade and ring covers is difficult to ensure. Therefore, most of the prior art lampshades are formed by assembling the ring covers and lampshade cloths together at the time of shipment, and then they are packaged. However, due to the large volume occupied by an inner cavity defined by the assembled lampshade cloth and the ring covers, the proportion of transportation cost occupied during transportation is also large. Obviously, the prior art lampshade will be transported after assembly, which will result in higher transportation costs, especially in foreign trade with high transportation costs. Secondly, during the transportation, the lampshade cloth is also susceptible to bending deformation due to collision, which increases the rejection rate and further increases the cost of production and transportation.

SUMMARY OF THE INVENTION

A primary object of the present invention is to provide a lampshade that is easy to assemble and that reduces transportation costs.

Another object of the present invention is to provide a lamp using the above lampshade.

In order to achieve the above objects, the present invention provides the following technical solution.

A lampshade includes at least two ring covers arranged one above the other and a lampshade cloth surrounding an outer circumferential wall of each of the ring covers to form a closed cover body. The lampshade cloth includes a mounting surface and a decorative surface, which are oppositely disposed. A rib and a groove for connecting and fixing the lampshade cloth and the ring cover are disposed between the outer circumferential wall of the ring cover and the mounting surface of the lampshade respectively. The rib and the groove are elastically snap-fitted. The lampshade cloth is elongated and both ends of it are detachably connected with each other.

Through the above structure, the lampshade cloth and the ring cover are fixed to each other by the elastic snap fit of the rib and the groove. Obviously, the connection of the rib and the groove has a guiding effect, so that the lampshade cloth and the ring cover can be connected along an extending direction of the rib and the groove, thereby making the relative position of the rib and the groove be fixed after installation. It also reduces the difficulty of assembling the lampshade cloth and the ring cover, and can ensure the consistency of assembling the lampshade together by different operators without affecting the aesthetics of the product. Therefore, after manufacturing the lampshade, it is not necessary to assemble the lampshade cloth and the ring cover in advance, and the lampshade cloth can be wound up to reduce the space occupied, and this will greatly reduce the packaging volume and reduce transportation costs. In addition, since the lampshade cloth is packaged by winding or lying flat and packaging, it is not easily affected by vibration or collision during transportation, the rejection rate is reduced, and the transportation cost and production cost of the product are further controlled.

The rib includes a protruding portion and an elastic engaging portion extending from a distal end of the protruding portion towards both sides of the protruding portion. A limiting portion that can be engaged with the elastic engaging portion is oppositely formed at an opening of the groove.

Using the above technical solution, when the rib is connected with the groove, the rib is inserted into the groove. The elastic engaging portion is deformed after being abutted against the limiting portion and is hooked on an inner side of the limiting portion to secure the protruding strip and the groove together. This installation method is simple and fast, and can maintain good connection stability.

The rib is disposed on the outer circumferential wall of the ring cover, and the groove is defined in the lampshade cloth.

Using the above technical solution, by forming the groove in the lampshade cloth, the lampshade cloth is easy to wind up to a reduced size, and this can reduce packaging volume largely and reduce transportation costs.

One of the ring covers includes a ring body, a mounting member disposed at a central position of the ring body for mounting a lamp body thereon, and a connecting rod for connecting the mounting member and the ring body.

Using the above technical solution, the mounting member, and the connecting rod can be used for connecting the lamp body to form a support for the lamp body, so the connection structure is simple and has good structural stability.

A circumferential wall of the mounting member and the inner circumferential wall of the ring body are respectively provided with an engaging slot for inserting the two ends of the connecting rod therein. There are at least two connecting rods, and a plurality of the connecting rods are symmetrically arranged with respect to the center of the mounting member.

Using the above technical solution, the connecting rod is inserted into the engaging slot of the mounting member and the ring body through the two ends thereof. The plurality of connecting rods interact to realize the connection and fixing of the connecting rods, the mounting member and the ring body, and by this way, connection structure is simple, the assembly is convenient and fast.

The ring cover includes a plurality of sub-rods that are connected end to end to form a closed ring. Two adjacent sub-rods are connected with each other in a detachable manner.

Using the above technical solution, the ring cover is detachable into a plurality of sub-rods, thus further reducing the packaging volume of the ring cover and reducing transportation costs.

An end surface of the sub-rod extends along a length direction thereof to form a locating block, while the other end surface of the sub-rod is provided with a locating groove for the locating block on the adjacent sub-rod to be inserted and fixed therein.

Using the above technical solution, when the sub-rods are assembled to form a ring cover, the adjacent two sub-rods are connected by inserting the locating block into a corresponding locating groove. When the closed ring cover is formed, the locating block and the locating groove form a snap-fit relationship, so that the plurality of sub-rods are fixed to each other, and the connection structure is simple and stable.

A front end and a rear end of the lampshade cloth are overlapped and stuck to each other.

Using the above technical solution, the two ends of the lampshade cloth are fixed by bonding and form a closed ring cover, and the connection structure is stable and firm. In addition, it can maintain a small gap in a bonding interface to maintain the aesthetics of the product.

A support rod is connected between the plurality of ring covers, and the support rod is detachably connected to the ring cover.

Using the above technical solution, on one hand, the support rod is connected between the ring covers for connecting the plurality of ring covers and forming together with the ring covers the main body frame of the lampshade, so that the lampshade cloth can be more easily aligned with the ring covers, and the assembly is more convenient, fast and efficient. On the other hand, the support rod is connected between the ring covers, which improves the strength of the entire lampshade and makes the lampshade more stable when supporting the lamp body.

A mounting groove for inserting the two ends of the support rod therein is disposed oppositely between two adjacent ring cover.

Using the above technical solution, by inserting the two ends of the support rod into the mounting groove, the support rod and the two ends of the ring cover are connected and fixed, and the support rod provides support for the ring cover.

An elastic engaging opening is defined in the mounting groove at the inner circumferential wall of the ring cover for the support rod to escape.

Using the above technical solution, after the lampshade cloth and the ring cover are assembled together, the elastic engaging opening can facilitate the separation of the support rod to separate from the ring cover. Removing the support rod can prevent formation of shadow due to light obstruction by the support rod during use, thereby maintaining the aesthetics of the product during use.

The lampshade cloth is a light-transmitting cloth or a light-shielding cloth.

Using the above technical solution, the material of the lampshade cloth can be selected according to actual needs. When a light-transmitting material is selected, the light-transmitting cloth allows the light to illuminate the lampshade and at the same time softens the light, while when a light-shielding cloth is used, the light is only emitted along the vertical ends of the lampshade, thus guiding the light.

The mounting surface is a reflective surface or a matte surface.

Using the above technical solution, when the mounting surface is a reflective surface, the light is emitted from both ends of the lampshade after being reflected by the reflective surface. The color of the reflected light can be determined by the color of the reflective surface, which can control the color temperature of the light while improving the light utilization rate.

As a second aspect, the present invention also provides a lamp including the above-described lightshade and a lamp body mounted in the lightshade.

Compared with the prior art, the solution of the invention has the following advantages.

At first, in the lampshade of the invention, the lampshade cloth and the ring cover are fixed to each other by the elastic snap fit of the rib and the groove. Obviously, the connection of the rib and the groove has a guiding effect, so that the lampshade cloth and the ring cover can be connected along an extending direction of the rib and the groove, thereby making the relative position of the rib and the groove be fixed after installation. Such a structural design reduces the difficulty of assembling the lampshade cloth and the ring cover, and can ensure the consistency of assembling the lampshade together by different operators without affecting the aesthetics of the product. Therefore, after manufacturing the lampshade, it is not necessary to assemble the lampshade cloth and the ring cover in advance, and the lampshade cloth can be wound up to reduce the space occupied. When transporting in bulk, the lampshade cloth and the ring cover can be separated and packaged separately, for example, the lampshade cloth is laid flat and then packaged, and the ring cover is separately stacked for packaging. This will greatly reduce the packaging volume and reduce transportation costs, especially for long-distance transportation and even overseas transportation. In addition, since the lampshade cloth is packaged by winding or lying flat and packaging, it is not easily affected by vibration or collision during transportation, the rejection rate is reduced, and the transportation cost and production cost of the product are further controlled.

Secondly, in the lampshade of the invention, by splitting the ring cover into a plurality of sub-rods, the size of the sub-rods is greatly reduced compared to the package volume of the ring cover, thus further reducing the transportation cost of the product.

Thirdly, in the lampshade of the invention, by providing the support rod between the ring covers, on one hand, the support rod is connected between the ring covers for connecting the plurality of ring covers and forming together with the ring covers the main body frame of the lampshade, so that the lampshade cloth can be more easily aligned with the ring covers, and the assembly is more convenient, fast and efficient. During use, the support rod can be selected to connect with the ring cover as needed. When the lampshade cloth is a light-shielding material, the support rod can provide support for the ring cover and enhance the overall strength of the lampshade. When the lampshade cloth is a light transmitting material, the support rod can be removed to prevent formation of shadow due to light obstruction by the support rod during use, thereby maintaining the aesthetics of the product during use.

The additional aspects and advantages of the invention will be set forth in part in the description which follows.

BRIEF DESCRIPTION OF THE DRAWINGS

The above and/or additional aspects and advantages of the present invention will become apparent and readily understood from various embodiments described in conjunction with the drawings, in which.

DETAILED DESCRIPTION OF THE INVENTION

Figure 1:
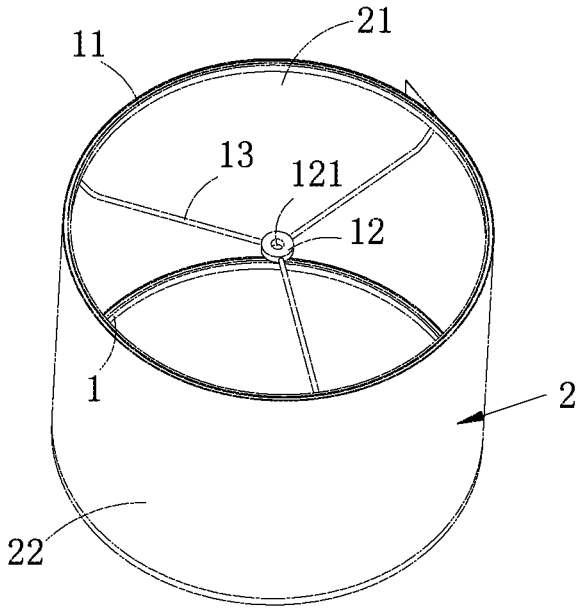
FIG. 1 is a schematic structural view of an embodiment of the present invention.

The embodiments of the present invention are described in detail below, and the examples of the embodiments are illustrated in the drawings, wherein the same or similar reference numerals are used to refer to the same or similar elements or elements having the same or similar functions. The embodiments described below with reference to the drawings are illustrative and are merely illustrative of the invention and are not to be construed as limiting the invention.

Figure 2:
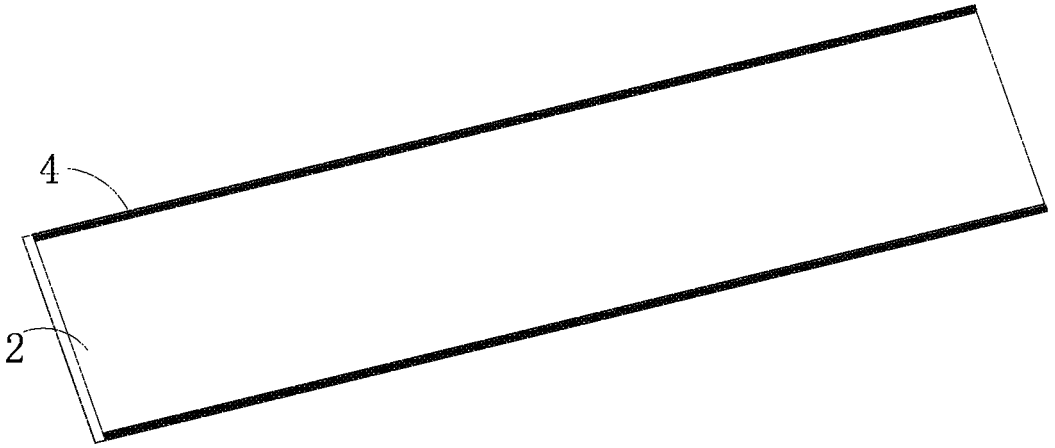
FIG. 2 is a schematic view showing a state in which a lampshade cloth is unfolded according to an embodiment of the present invention.
Figure 3:
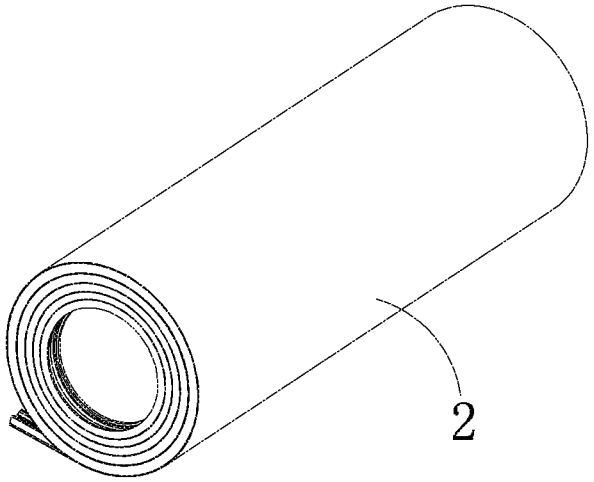
FIG. 3 is a schematic view showing a state in which a lampshade cloth is wound in an embodiment of the present invention.

As shown in FIGS. 1 to 3, the present invention provides a lampshade and a lamp. The lamp includes the lampshade and a lamp body mounted in the lampshade, the lampshade including at least two ring covers 1 and a lampshade cloth 2. The lampshade cloth 2 is disposed on an outer circumferential wall of the ring covers 1 to form a closed cover body.

In this embodiment, there are two ring covers 1, and each of them is annular; while in other embodiments, the ring cover 1 may also be square or other polygonal shape; there may be three or more ring covers, and they may be arranged up and down.

Both ends of the lampshade cloth 2 are elongated and detachably connected with each other, and it includes a mounting surface 21 and a decorative surface 22 which are oppositely disposed. Specifically, the mounting surface 21 is disposed on an inner side of the lampshade, and the decorative surface 22 is disposed on an outer side of the lampshade.

A rib 3 and a groove 41 for connecting and fixing the lampshade cloth 2 and the ring cover 1 are disposed between the outer circumferential wall of the ring cover 1 and the mounting surface 21 of the lampshade 2 respectively. The rib 3 and the groove 41 are elastically snap-fitted.

Through the above structure, the lampshade cloth 2 and the ring cover 1 are fixed to each other by the elastic snap fit of the rib 3 and the groove 41. Obviously, the connection of the rib 3 and the groove 41 has a guiding effect, so that the lampshade cloth 2 and the ring cover 1 can be connected along an extending direction of the rib 3 and the groove 41, thereby making the relative position of the rib 3 and the groove 41 be fixed after installation. Such a structural design reduces the difficulty of assembling the lampshade cloth 2 and the ring cover 1, and can ensure the consistency of assembling the lampshade together by different operators without affecting the aesthetics of the product. Therefore, after manufacturing the lampshade, it is not necessary to assemble the lampshade cloth 2 and the ring cover 1 in advance, and the lampshade cloth 2 can be wound up to reduce the space occupied. When transporting in bulk, the lampshade cloth 2 and the ring cover 1 can be separated and packaged separately, for example, the lampshade cloth 2 is laid flat and then packaged, and the ring cover 1 is separately stacked for packaging. This will greatly reduce the packaging volume and reduce transportation costs, especially for long-distance transportation and even overseas transportation. In addition, since the lampshade cloth 2 is packaged by winding or lying flat and packaging, it is not easily affected by vibration or collision during transportation, and the rejection rate is reduced, and the transportation cost and production cost of the product are further controlled.

When it is required to wind up and package the lampshade cloth 2, the thickness of the rib 3 or the groove 41 on the lampshade cloth 2 may increase the difficulty of winding the cover cloth 2. Therefore, in order to ensure that the lampshade cloth 2 can be smoothly wound up to have a small diameter, the thickness of the rib 3 or the groove 41 should be reduced as much as possible while ensuring the connection strength of the lampshade cloth and the ring cover. In addition, since the lampshade is composed of the ring cover 1 and the lampshade cloth 2, the ring cover 1 needs to support the lamp body while supporting the lampshade cloth 2. The ring cover 1 is required to have a certain supporting strength, that is, the volume of the ring cover 1 has certain requirements. In combination with the above two requirements, in the present embodiment, a tangent location between the lampshade 2 and the ring cover 1 is provided with the rib 3 and groove 41. The volume of the ring cover 1 and the ribs 3 or the grooves 41 do not affect each other, that is, while ensuring that the ring cover 1 has a certain structural strength, the thickness of the rib 3 or the groove 41 is made as small as possible, making the lampshade 2 easier to be wound.

Figure 4:
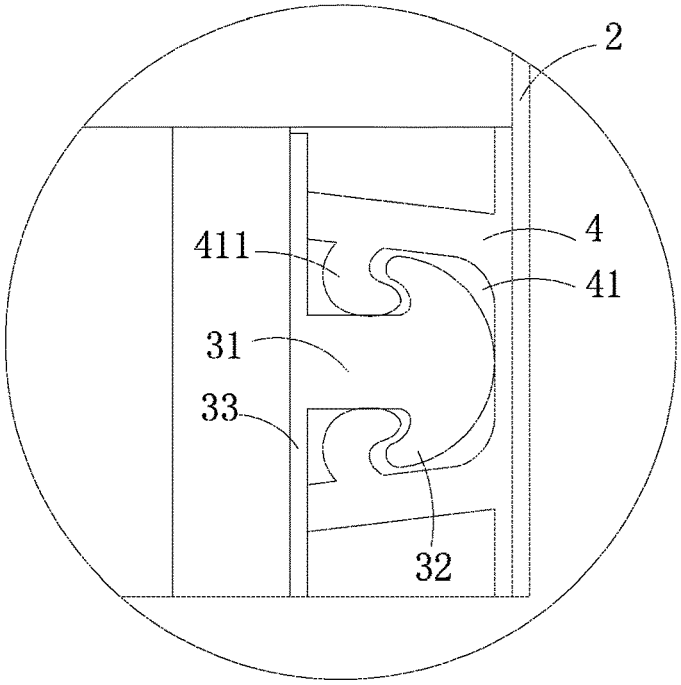
FIG. 4 is a schematic view showing a connection structure of a lampshade cloth and a ring cover according to an embodiment of the present invention.

As shown in FIG. 4, the rib 3 includes a protruding portion 31 and an elastic engaging portion 32 extending from a distal end of the protruding portion 31 towards both sides of the protruding portion 31. A limiting portion 411 that can be engaged with the elastic engaging portion 32 is oppositely formed at an opening of the groove 41. Specifically, the common cross section of the protruding portion 31 and the elastic engaging portion 32 has an arrow shape. In other embodiments, the distal end of the protruding portion 31 may extend only to one side to form one of the elastic engaging portions 32.

When the rib 3 is connected with the groove 41, the rib 3 is inserted into the groove 41. The elastic engaging portion 32 is deformed after being abutted against the limiting portion 411 and is hooked on an inner side of the limiting portion 411 to secure the protruding strip 3 and the groove 41 together. This installation method is simple and fast, and can maintain good connection stability.

In the embodiment, the rib 3 is disposed on the outer circumferential wall of the ring cover 1, and the groove 41 is defined in the lampshade cloth 2. Specifically, the rib 3 further includes an adhesive portion 33 integrally formed with the protruding portion 31 for bonding and fixing to the outer circumferential wall of the ring cover 1. A mounting strip 4 of plastic material is adhered to the lampshade cloth 2, and the groove 41 is defined in the mounting strip 4. By forming the groove 41 in the lampshade cloth 2, the lampshade cloth 2 is easier to wind up than the rib 3, and has less influence on the structure, thus preventing damage of the lampshade cloth 2 during winding.

In other embodiments, the rib 3 and the ring cover 1 may be made of plastic material, and the two are integrally molded by injection molding. Alternatively, the rib 3 is injection molded, and the ring cover 1 is a metal ring and is wrapped in the rib 3. In addition, the positions of the rib 3 and the groove 41 on the ring cover 1 and the cover cloth 2 respectively can be exchanged with each other.

In this embodiment, the front and rear ends of the lampshade cloth 2 are overlapped and fixed to each other. Specifically, both ends of the lampshade cloth 2 are fixed by means of a sticker. In other embodiments, the two ends of the lampshade cloth 2 can be connected and fixed by the matching structure of the rib 3 and the groove 41 in the embodiment, and can also be fixed by means of a Velcro. In addition, a slit may be formed between the ends of the lampshade cloth 2, and the two ends may be connected by inserting a clipping strip into the slit.

As shown in FIG. 1, one of the ring covers 1 includes a ring body 11, a mounting member 12 disposed at a central position of the ring body 11 for mounting a lamp body thereon, and a connecting rod 13 for connecting the mounting member 12 and the ring body 11. The mounting member 12 defines a mounting groove 121 in the center thereof. After a screw bolt passes through the mounting groove 121, the mounting and fixing between the lamp body and the mounting member 12 is achieved by screwing the screw bolt with a nut. In another embodiment, the mounting groove 121 can also be a threaded hole, thereby avoiding the use of a nut and facilitating the connection.

In an embodiment, the lampshade cloth 2 is a light-shielding cloth, and the mounting surface 21 is a reflective surface, and the color of the reflective surface can be freely selected according to needs, preferably warm color. The decorative surface 22 of the lampshade cloth 2 can be a solid color material, and the consumer can paint it according to the preference, enriching the fun of the product.

In other embodiments, the mounting surface 21 can be a matte surface, and the decorative surface 22 of the lampshade cloth 2 can also be formed into a specific pattern by inkjet printing, thus improving the variety of appearance of the product.

In other embodiments, the lampshade cloth 2 can also be a light-transmitting cloth, which can soften the light and protect the human eye from irritation.

It should be understood that the lampshade cover 2 is a roll-able component and should not be regarded as a limitation to the material. The material of the lampshade cover 2 of the present invention may be cotton cloth, linen cloth or rayon cloth, and may also be a roll-able cardboard or a flexible plastic film such as PVC, or the like.

Figure 5:
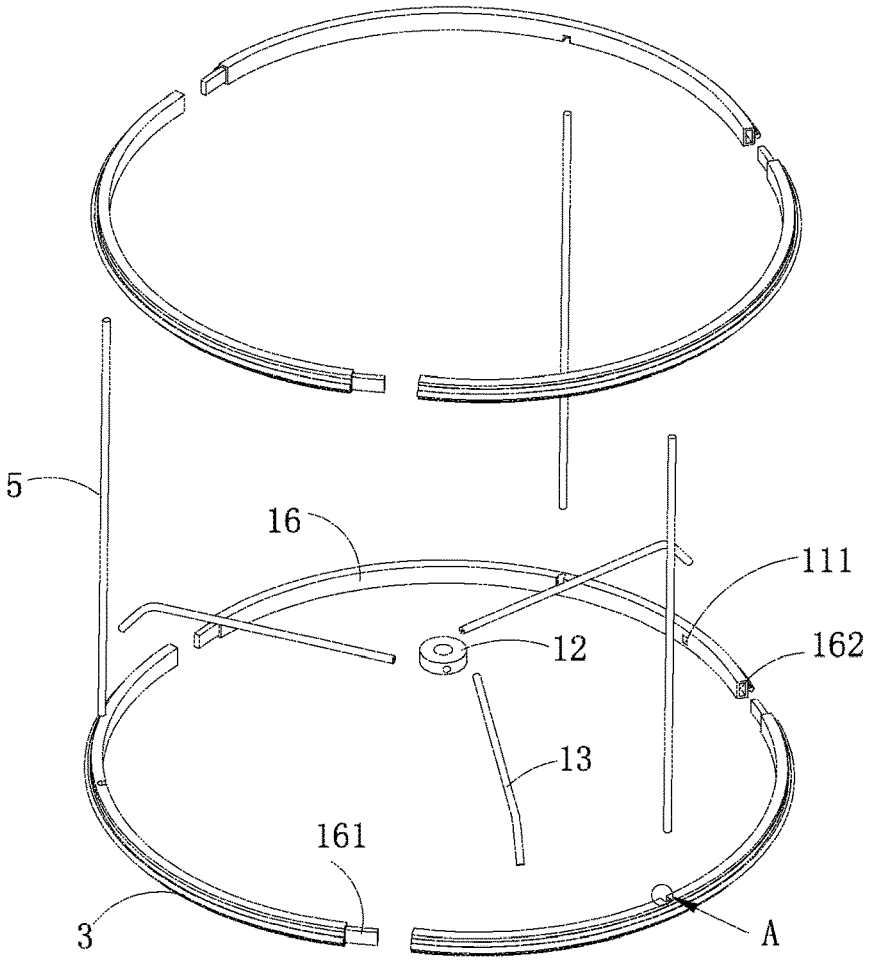
FIG. 5 is an exploded perspective view of a lampshade according to an embodiment of the present invention.
Figure 6:
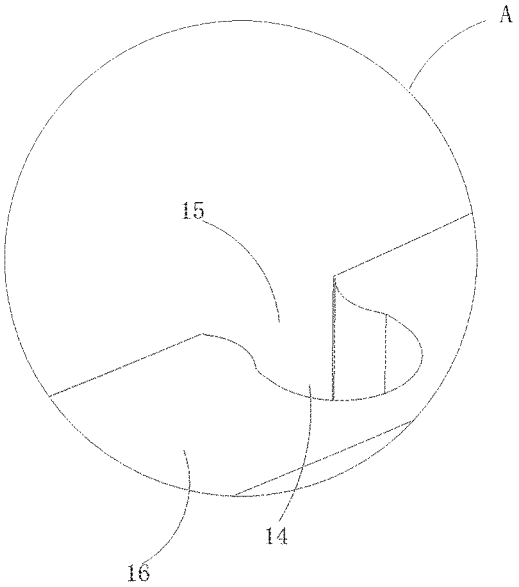
FIG. 6 is an enlarged schematic view of portion A in FIG. 5.

As shown in FIGS. 5 and 6, in the present embodiment, the lampshade cover further includes a support rod 5 connected between the two ring covers 1, and the support rod 5 is detachably coupled to the ring covers 1. Preferably, a plurality of the support rods 5 is uniformly disposed along the circumferential direction of the ring cover 1. Mounting grooves 14 are provided between the two ring covers 1 for inserting the two ends of the support rod 5 therein. When the number of the ring covers 1 is greater than two, the support rods 5 are disposed between the adjacent ring covers 1. Therefore, in case where only the ring cover 1 at a top end and the ring cover 1 at a bottom end are provided with the ribs 3 (or the grooves 41) for being connected to the lampshade cloth 2, it is used to support the ring cover 1 at an intermediate position.

By providing the support rod 5 between the ring covers 1, on one hand, the support rod 5 is connected between the ring covers 1 for connecting the plurality of ring covers 1 and forming together with the ring covers 1 the main body frame of the lampshade, so that the lampshade cloth 2 can be more easily aligned with the ring covers 1, and the assembly is more convenient, fast and efficient. On the other hand, the support rod 5 is connected between the ring covers 1, which improves the strength of the entire lampshade and makes the lampshade more stable when supporting the lamp body.

In this embodiment, elastic engaging opening 15 is defined in the mounting groove 14 at the inner circumferential wall of the ring cover 1 for the support rod 5 to escape. Preferably, the elastic engaging opening 15 is provided with a guiding surface for facilitating the support rod 5 to enter or leave the mounting groove 14.

By providing the elastic engaging opening 15 on the inner circumferential wall of the ring cover 1, the elastic engaging opening 15 helps fix the support rod 5, and at the same time, it is convenient to let the support rod 5 escape from the mounting groove 14 after the lampshade cloth 2 and the ring cover 1 are connected. When the lampshade cloth 2 is a light-transmitting material, the support rod 5 can be used only as an auxiliary member for assembling the lampshade cloth 2 and the ring cover 1. After the lampshade cloth 2 and the ring cover 1 are assembled, the support rod 5 can be taken out from the mounting groove 14 through the elastic engaging opening 15. Avoid the support rod 5 to block the light during use, resulting in shadow on the lampshade to maintain the aesthetic appearance of the product. When the lampshade cloth 2 is a light-shielding material, after the lampshade cloth 2 and the ring cover 1 are assembled, the support rod 5 does not need to be taken out from between the ring covers 1, and the structural strength of the entire lampshade is improved. That is, the user can select whether or not to connect the support rod 5 between the ring covers 1 according to the needs of use.

Figure 7:
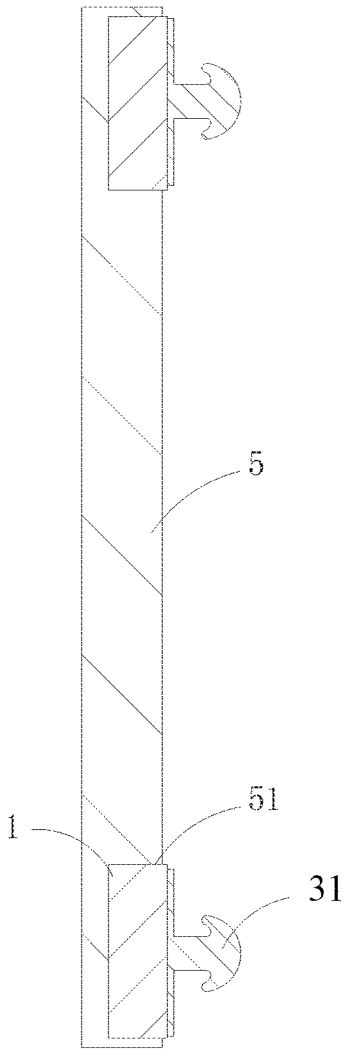
FIG. 7 is a cross-sectional view showing the connection structure of a support rod and the ring cover according to another embodiment of the present invention.

As shown in FIG. 7, in another embodiment, the support rod 5 can also have a clamping notch 51 at both ends thereof for clamping the ring cover 1. The clamping action of the ring cover 1 is formed by the clamping notch 51 on the support rod 5, thereby achieving the connection and fixing of the ring cover 1 and the support rod 5. The support rod 5 and the two ring covers 1 form a cylindrical frame, which facilitates the fixing of the lampshade cloth and the ring covers.

In one embodiment, the ring cover 1 includes a plurality of sub-rods 16 that are connected end to end to form a closed ring. Correspondingly, the rib 3 can be divided into a plurality of segments, and the detachable connection is realized between the adjacent sub-rods 16. When the ring cover 1 is provided with a mounting member 12 for mounting a lamp body, the ring cover 1 includes the ring body 11 and the mounting member 12. The ring body 11 is formed by connecting a plurality of the sub-rods 16, and the connecting rod 13 may be detachably connected to the mounting member 12 and the ring body 11 respectively.

Specifically, an end surface of the sub-rod 16 extends along a length direction thereof to form a locating block 161, while the other end surface of the sub-rod 16 is provided with a locating groove 162 for the locating block 161 on the adjacent sub-rod 16 to be inserted and fixed therein. A circumferential wall of the mounting member 12 and the inner circumferential wall of the ring body 11 are respectively provided with an engaging slot 111 for inserting the two ends of the connecting rod 13 therein. There are at least two connecting rods 13, and a plurality of the connecting rods 13 are symmetrically arranged with respect to the center of the mounting member 12. In the present embodiment, three of the connecting rods 13 are provided.

In this embodiment, the ring cover 1 can be split into a plurality of sub-rods 16, and the connecting rod 13 can be detachably connected to the mounting member 12 and the ring body 11 respectively. The ring cover 1 can be split into several sub-rods 16 occupying a smaller space during packaging and transportation, thus further reducing transportation costs. Specifically, the plurality of sub-rods 16 are connected end to end to form an annular shape by means of the locating block 161 and the locating groove 162 disposed at both ends of the sub-rods 16, so that the plurality of sub-rods 16 are fixed to each other. The connecting rod 13 is inserted into the engaging slot 111 of the mounting member 12 and the ring body 11 through the two ends thereof. The plurality of connecting rods 13 interact to realize the connection and fixing of the connecting rods 13, the mounting member 12 and the ring body 11, and by this way, the installation structure is simple, the installation parts are less, the assembly is convenient, and the connection stability is good.

In other embodiments, the plurality of sub-rods 16 can also be fixed with each other by a snap connection structure, or can be fixed by bolts and nuts. Similarly, the connecting rod 13 and the connecting member and the ring body 11 can also be fixed to each other by a snap connection structure, or can be fixed by bolts and nuts.

Figure 8:
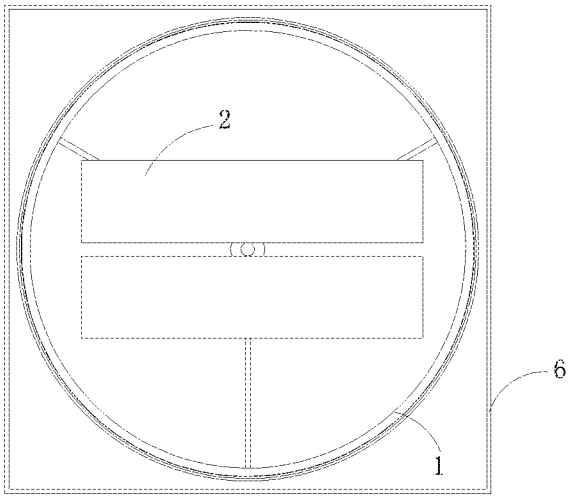
FIG. 8 is a schematic view showing a packaged state of a lampshade according to an embodiment of the present invention.
Figure 9:
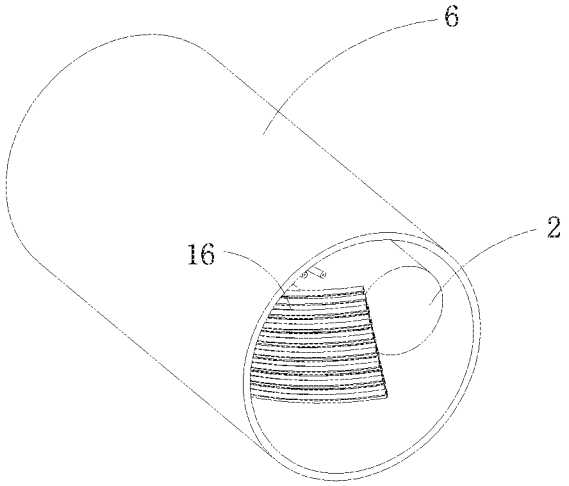
FIG. 9 is a schematic view showing a packaged state of a lampshade according to another embodiment of the present invention.

With reference to FIGS. 8 and 9, the present invention also provides a package structure of a lampshade. It includes the above-mentioned lampshade and a package box 6 for packaging the lampshade. When the lampshade cloth 2 is packaged in the package box 6, the cover cloth 2 is wound into a cylindrical shape along its length direction. The package box 6 can be used for packaging a plurality of lampshades. In this embodiment, a plurality of ring covers 1 is stacked on each other. The lampshades 2 are respectively wound up and placed laterally in the package box 6. In other embodiments, the lampshade cloth 2 can also be placed vertically in the middle of the ring cover 1 after being wound up.

When the lampshade is packaged, the lampshade cloth 2 can be wound up to form a cylindrical shape, thereby saving the space occupied by the lampshade cloth 2. The ring covers 1 are stacked on each other, and the lampshade cloth 2 is stacked on the ring cover 1 laterally, which greatly reduces the volume of the product package and reduces the transportation cost of the product. When the package box 6 simultaneously packs a plurality of lampshades, the lampshade cloth 2 can be packaged in a lateral or vertical manner in the middle of the ring cover 1. Packing multiple lampshades together can make better use of the internal storage space of the package box 6, improving space utilization and reducing transportation costs.

When the ring cover 1 is a detachable structure, that is, when the ring cover 1 includes the sub-rods 16, the mounting member 12, the connecting rod 13 and the support rod 5, the sub-rods 16, the mounting member 12, the connecting rod 13 and the support rod 5 can be separated from each other and placed in the package box 6. At the same time, the lampshade cloth 2 is wound up and placed in the package box 6. By splitting the ring cover 1 into a plurality of sub-rods 16, the size of the sub-rods 16 is greatly reduced compared to the package volume of the ring cover 1. For the packaging of a single lampshade, its transportation costs can be further reduced. In other embodiments, the lampshade cloth 2 is wound and a receiving cavity is defined in its center. The sub-rods 16, the mounting member 12, the connecting rod 13 and the supporting rod 5 are placed in the receiving cavity.

The assembly process and packaging process of the lampshade of the present invention are as follows.

When the ring cover 1 is inseparable, the assembly process of the lampshade is as follows: both ends of the support rod 5 are inserted into the mounting grooves 14 of the two ring covers 1 respectively, thereby forming a main frame of the lampshade, then, the rib 3 on the ring cover 1 is inserted into the groove 41 on the lampshade cloth 2, so that the lampshade cloth 2 surrounds the outer circumference of the ring cover 1, and finally, the two ends of the lampshade 2 are bonded and fixed. The packaging process is: stacking the ring covers 1 on each other in the package box 6, and then winding the lampshade cloth 2 and stacking them on the ring cover 1 laterally.

When the ring cover 1 is detachable into a plurality of sub-rods 16, the assembly process of the lampshade is as follows: inserting the connecting rod 13 into the engaging slot 111 of the mounting member 12 and the sub-rod 16, then, fixing the plurality of split rods 16 by the engagement between the locating block 161 and the locating groove 162, then forming a closed ring cover 1 and connecting it to the support rod 5, and finally, connecting it to the lampshade 2. The packaging process is as follows: the plurality of sub-rods 16 is placed vertically in the package box 6, and the lampshade cloth 2 is placed in the package box 6 in a vertical state after being wound up, and the packaging process is completed.

The above is only a part of the embodiments of the present invention, and it should be noted that those skilled in the art can also make several improvements without departing from the principles of the present invention. It should be considered as the scope of protection of the present invention.

The invention claimed is:

1. A lampshade, comprising at least two ring covers arranged one above the other and a lampshade cloth surrounding an outer circumferential wall of each of the ring covers to form a closed cover body, the lampshade cloth comprising a mounting surface and a decorative surface, which are oppositely disposed, wherein a rib and a groove for connecting and fixing the lampshade cloth and the ring cover are disposed between the outer circumferential wall of the ring cover and the mounting surface of the lampshade respectively; the rib and the groove are elastically snap-fitted; and the lampshade cloth is elongated and both ends of it are detachably connected with each other, wherein the rib comprises a protruding portion and an elastic engaging portion extending from a distal end of the protruding portion towards both sides of the protruding portion and a limiting portion that can be engaged with the elastic engaging portion is oppositely formed at an opening of the groove.

2. A lampshade, comprising at least two ring covers arranged one above the other and a lampshade cloth surrounding an outer circumferential wall of each of the ring covers to form a closed cover body, the lampshade cloth comprising a mounting surface and a decorative surface, which are oppositely disposed, wherein a rib and a groove for connecting and fixing the lampshade cloth and the ring cover are disposed between the outer circumferential wall of the ring cover and the mounting surface of the lampshade respectively; the rib and the groove are elastically snap-fitted; and the lampshade cloth is elongated and both ends of it are detachably connected with each other, wherein the rib is disposed on the outer circumferential wall of the ring cover, and the groove is defined in the lampshade cloth.

3. The lampshade as recited in claim 1, wherein one of the ring covers includes a ring body, a mounting member disposed at a central position of the ring body for mounting a lamp body thereon, and a connecting rod for connecting the mounting member and the ring body.

4. The lampshade as recited in claim 3, wherein a circumferential wall of the mounting member and the inner circumferential wall of the ring body are respectively provided with an engaging slot for inserting the two ends of the connecting rod therein; and there are at least two connecting rods, and a plurality of the connecting rods are symmetrically arranged with respect to the center of the mounting member.

5. The lampshade as recited in claim 1, wherein the ring cover comprises a plurality of sub-rods that are connected end to end to form a closed ring; and two adjacent sub-rods are connected with each other in a detachable manner.

6. The lampshade as recited in claim 5, wherein an end surface of the sub-rod extends along a length direction thereof to form a locating block, while the other end surface of the sub-rod is provided with a locating groove for the locating block on the adjacent sub-rod to be inserted and fixed therein.

7. The lampshade as recited in claim 1, wherein a front end and a rear end of the lampshade cloth are overlapped and stuck to each other.

8. The lampshade as recited in claim 1, wherein a support rod is connected between the plurality of ring covers and the support rod is detachably connected to the ring cover.

9. The lampshade as recited in claim 8, wherein two mounting grooves for inserting the two ends of the support rod therein respectively are defined in the two adjacent ring covers respectfully.

10. The lampshade as recited in claim 9, wherein an elastic engaging opening is defined in the mounting groove at the inner circumferential wall of the ring cover.

11. The lampshade as recited in claim 1, wherein the lampshade cloth is a light-transmitting cloth or a light-shielding cloth.

12. The lampshade as recited in claim 1, wherein the mounting surface is a reflective surface or a matte surface.

13. A lamp, comprising a lightshade and a lamp body mounted in the lightshade, the lampshade comprising at least two ring covers arranged one above the other and a lampshade cloth surrounding an outer circumferential wall of each of the ring covers to form a closed cover body, the lampshade cloth comprising a mounting surface and a decorative surface, which are oppositely disposed, wherein a rib and a groove for connecting and fixing the lampshade cloth and the ring cover are disposed between the outer circumferential wall of the ring cover and the mounting surface of the lampshade respectively; the rib and the groove are elastically snap-fitted; and the lampshade cloth is elongated and both ends of it are detachably connected with each other, wherein the rib comprises a protruding portion and an elastic engaging portion extending from a distal end of the protruding portion towards both sides of the protruding portion; and a limiting portion that can be engaged with the elastic engaging portion is oppositely formed at an opening of the groove.

14. A lamp, comprising a lightshade and a lamp body mounted in the lightshade, the lampshade comprising at least two ring covers arranged one above the other and a lampshade cloth surrounding an outer circumferential wall of each of the ring covers to form a closed cover body, the lampshade cloth comprising a mounting surface and a decorative surface, which are oppositely disposed, wherein a rib and a groove for connecting and fixing the lampshade cloth and the ring cover are disposed between the outer circumferential wall of the ring cover and the mounting surface of the lampshade respectively; the rib and the groove are elastically snap-fitted; and the lampshade cloth is elongated and both ends of it are detachably connected with each other, wherein the rib is disposed on the outer circumferential wall of the ring cover, and the groove is defined in the lampshade cloth.

15. The lamp as recited in claim 13, wherein one of the ring covers includes a ring body, a mounting member disposed at a central position of the ring body for mounting a lamp body thereon, and a connecting rod for connecting the mounting member and the ring body.

16. The lamp as recited in claim 15, wherein a circumferential wall of the mounting member and the inner circumferential wall of the ring body are respectively provided with an engaging slot for inserting the two ends of the connecting rod therein; and there are at least two connecting rods, and a plurality of the connecting rods are symmetrically arranged with respect to the center of the mounting member.

17. The lamp as recited in claim 13, wherein the ring cover comprises a plurality of sub-rods that are connected end to end to form a closed ring; and two adjacent sub-rods are connected with each other in a detachable manner.

18. The lamp as recited in claim 17, wherein an end surface of the sub-rod extends along a length direction thereof to form a locating block, while the other end surface of the sub-rod is provided with a locating groove for the locating block on the adjacent sub-rod to be inserted and fixed therein.

* * * * *